US006778076B2

(12) United States Patent
Shidara et al.

(10) Patent No.: US 6,778,076 B2
(45) Date of Patent: Aug. 17, 2004

(54) OIL PRESSURE SWITCH FAILURE DETECTION SYSTEM FOR OUTBOARD MOTOR

(75) Inventors: Sadafumi Shidara, Wako (JP); Nobuhiro Takahashi, Takanezawa-machi (JP)

(73) Assignees: Honda Giken Kogyo Kabushiki Kaisha, Tokyo (JP); Keihin Corporation, Tokyo (JP)

( * ) Notice: Subject to any disclaimer, the term of this patent is extended or adjusted under 35 U.S.C. 154(b) by 30 days.

(21) Appl. No.: 10/028,360

(22) Filed: Dec. 28, 2001

(65) Prior Publication Data

US 2002/0084897 A1 Jul. 4, 2002

(30) Foreign Application Priority Data

Dec. 28, 2000 (JP) ..... 2000-400350

(51) Int. Cl.[7] ..... B60Q 1/00

(52) U.S. Cl. ..... 340/451; 340/449; 340/450.2; 123/179.7; 123/198 D; 73/53.04; 73/152.18; 73/708

(58) Field of Search ..... 340/451, 449, 340/450, 450.2, 450.3, 438, 439; 123/179.7, 179.5, 179.16, 179.17, 198 D, 196 S; 73/53.04, 54.16, 54.17, 152.18, 290 R, 708

(56) References Cited

U.S. PATENT DOCUMENTS 3,906,440 A * 9/1975 Haupt ..... 340/438
4,019,489 A * 4/1977 Cartmill ..... 123/198 D
5,195,476 A * 3/1993 Schwarz ..... 123/179.5
6,111,499 A * 8/2000 Morikami ..... 340/450.3
6,294,988 B1 * 9/2001 Shomura ..... 340/438
6,330,869 B1 * 12/2001 Yoshiki et al. ..... 123/90.15
6,484,127 B1 * 11/2002 Langervik ..... 702/184
6,614,345 B2 * 9/2003 Kimata et al. ..... 340/450.3

* cited by examiner

*Primary Examiner*—Jeffery Hofsass
*Assistant Examiner*—Daniel Previl
(74) *Attorney, Agent, or Firm*—Westerman, Hattori, Daniels & Adrian, LLP

(57) ABSTRACT

An oil pressure switch failure detection system for an outboard motor, having a first oil pressure switch which generates an ON signal indicating that the oil pressure is less than or equal to a first predetermined oil pressure and a second oil pressure switch which generates an ON signal indicating that the oil pressure is less than or equal to a second predetermined oil pressure which is set higher than the first predetermined oil pressure. In the system, by discriminating whether the generated signals of the first and second oil pressure switches are equal to be expected signals expected under operating conditions of the engine, it is determined whether at least one of the first and second oil pressure switches fails. With this, it become possible to detect failure of the first and second oil pressure switches, accurately.

30 Claims, 14 Drawing Sheets

FIG. 15

| | PATTERN 1 | PATTERN 2 | PATTERN 3 | PATTERN 4 |
|---|---|---|---|---|
| 1ST OIL PRESSURE SWITCH OUTPUT | OFF | OFF | ON | ON |
| 2ND OIL PRESSURE SWITCH OUTPUT | OFF | ON | OFF | ON |
| DETERMINATION | 1ST AND 2ND OIL PRESSURE SWITCHES ARE NORMAL | 2ND OIL PRESSURE SWITCH FAILS IF THIS OCCURS CONSECUTIVELY DURING SUCCESSIVE TWICE ENGINE STARTING | 1ST OIL PRESSURE SWITCH FAILS | 1ST AND 2ND OIL PRESSURE SWITCHES FAIL IF THIS OCCURS CONSECUTIVELY DURING SUCCESSIVE TWICE ENGINE STARTING |

OIL PRESSURE SWITCH FAILURE DETECTION SYSTEM FOR OUTBOARD MOTOR

BACKGROUND OF THE INVENTION

1. Field of the Invention

This invention relates to an oil pressure switch failure detection system for an outboard motor, particularly to a system for detecting failure of a pressure switch(es) that generates an output in response to the pressure of engine oil (lubricant) to be supplied to an internal combustion engine for an outboard motor for small boats.

2. Description of the Related Art

An outboard motor has an oil pressure switch(es) or sensor(s), installed at an appropriate location of a hydraulic circuit of the internal combustion engine or of an oil pan, which generates an ON signal when the oil pressure drops below a predetermined operating point and when the ON signal is generated, it warns to the operator and controls the fuel injection amount and ignition timing so as to decrease the engine speed to a level under which the engine is not suffered from damages such sticking or wear due to metal-to-metal contact.

If such an oil pressure switch or sensor fails, when the oil pressure is, in fact, sufficient, the oil pressure could nevertheless be determined to be abnormal. Or, the abnormality of oil pressure could be overlooked.

SUMMARY OF THE INVENTION

An object of the present invention is therefore to solve the aforesaid problems by providing an oil pressure switch failure detection system for outboard motor, which can accurately detect failure of an oil pressure switch which generates an output in response to the pressure of engine oil to be supplied to an internal combustion engine for an outboard motor for small boats.

For realizing this object, the invention provides a system for detecting failure of oil pressure switches which generate signals in response to a pressure of oil to be supplied to an internal combustion engine for an outboard motor for small boats, comprising: a first oil pressure switch which generates a signal indicating that the oil pressure is less than or equal to a first predetermined oil pressure; a second oil pressure switch which generates a signal indicating that the oil pressure is less than or equal to a second predetermined oil pressure which is set higher than the first predetermined oil pressure; switch signal discriminating means for discriminating whether the generated signals of the first and second oil pressure switches are equal to be expected signals expected under operating conditions of the engine; and switch failure determining means for conducting a determination as to whether at least one of the first and second oil pressure switches fails based on a result of discrimination of the switch signal determining means.

BRIEF DESCRIPTION OF THE DRAWINGS

This and other objects and advantages of the invention will be made more apparent with reference to the following description and drawings, in which:

FIG. 5 is a graph showing oil pressure PO with respect to engine speed NE and the oil temperature TO;

FIG. 15 is a table showing the processing in the flow chart of FIG. 12 through the illustration of the outputs of the oil pressure switches and determination of failure in response to the outputs.

DETAILED DESCRIPTION OF THE PREFERRED EMBODIMENT

An oil pressure switch failure detection system for an outboard motor according to an embodiment of the present invention will now be explained with reference to the attached drawings.

Figure 1:
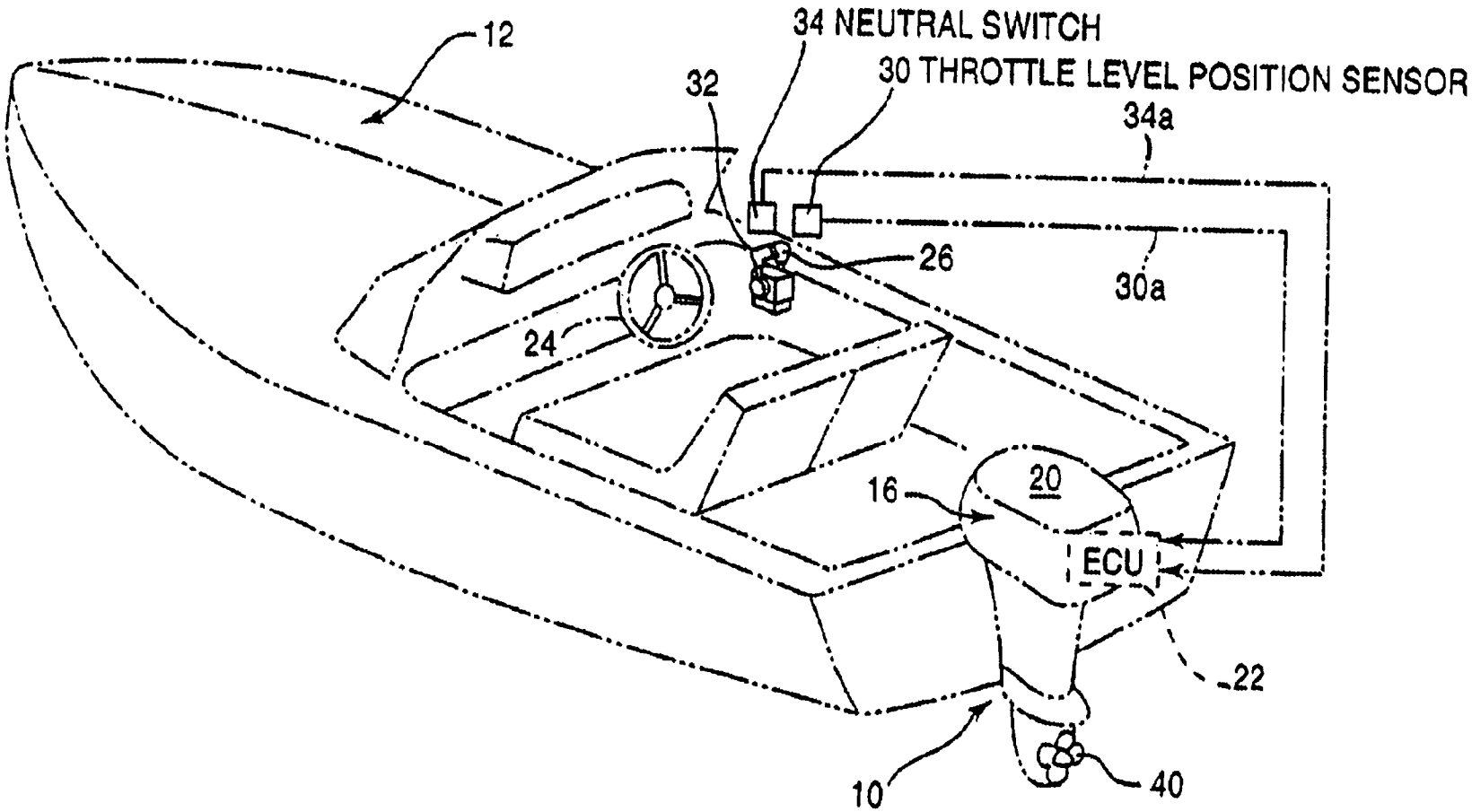
FIG. 1 is a schematic view showing the overall configuration of the oil pressure switch failure detection system for an outboard motor according to an embodiment of the present invention.
Figure 2:
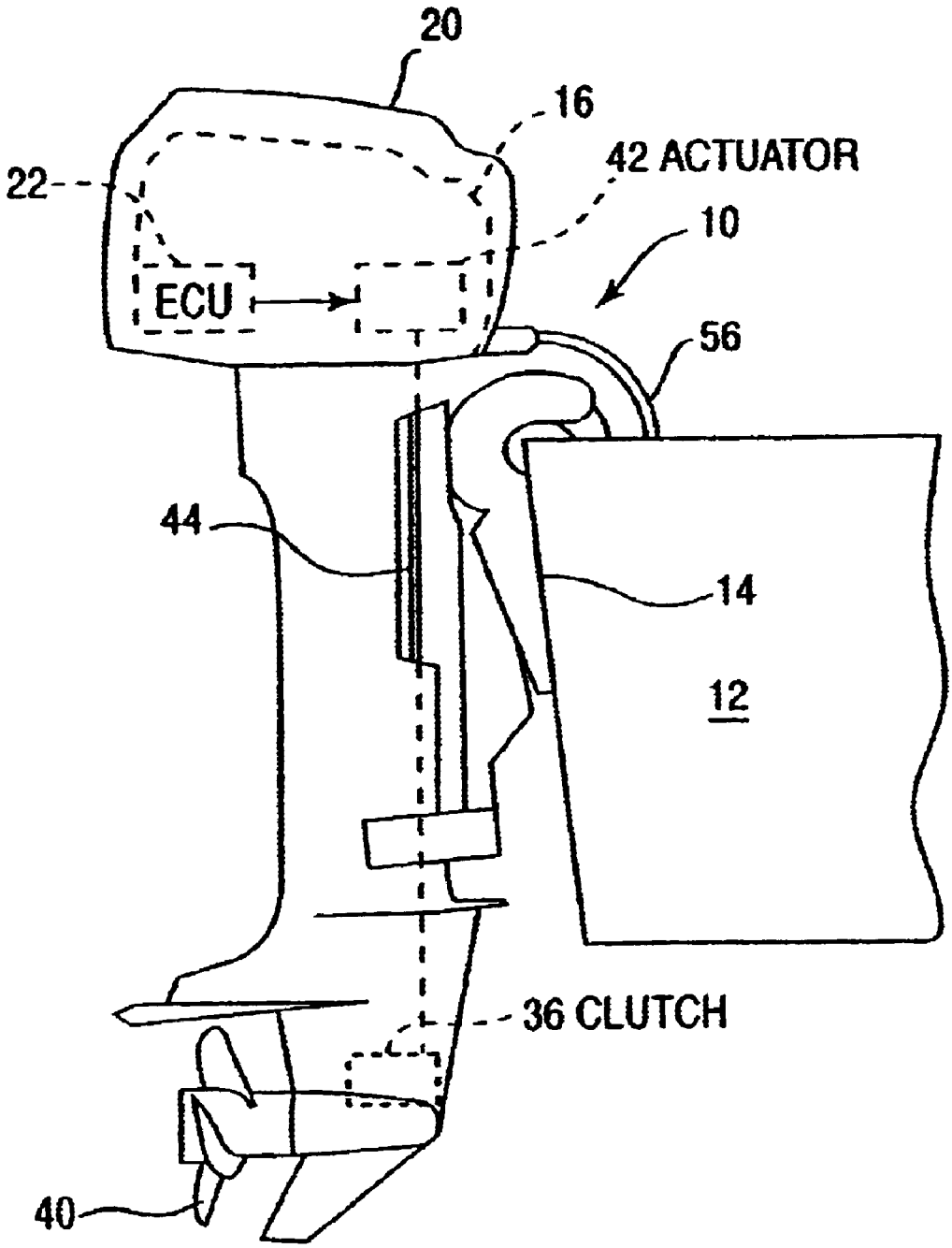
FIG. 2 is an enlarged side view of one portion of FIG. 1.

FIG. 1 is a schematic view showing the overall configuration of the oil pressure switch failure detection system for an outboard motor and FIG. 2 is an enlarged side view of one portion of FIG. 1.

Reference numeral 10 in FIGS. 1 and 2 designates a propulsion unit including an internal combustion engine, propeller shaft and propeller integrated into what is hereinafter called an "outboard motor." The outboard motor 10 is mounted on the stem of a boat (small craft) 12 by a clamp unit 14 (shown in FIG. 2).

As shown in FIG. 2, the outboard motor 10 is equipped with the internal combustion engine (hereinafter simply called the "engine") 16. The engine 16 is a spark-ignition V-6 gasoline engine. The engine is positioned above the water surface and is enclosed by an engine cover 20 of the outboard motor 10. An electronic control unit (ECU) 22 composed of a microcomputer is installed near the engine 16 enclosed by the engine cover 20.

As shown in FIG. 1, a steering wheel 24 is installed in the cockpit of the boat 12. When the operator turns the steering wheel 24, the rotation is transmitted to a rudder (not shown) fastened to the stern through a steering system not visible in the drawings, changing the direction of boat advance.

A throttle lever 26 is mounted on the right side of the cockpit and near it is mounted a throttle lever position sensor 30 that outputs a signal corresponding to the position of the throttle lever 26 set by the operator. A shift lever 32 is provided adjacent to the throttle lever 26 and next to it is installed a neutral switch 34 that outputs an ON signal when the operator puts the shift lever 32 in Neutral and outputs an OFF signal when the operator puts the shift lever 32 in Forward or Reverse. The outputs from the throttle lever position sensor 30 and neutral switch 34 are sent to the ECU 22 through signal lines 30*a* and 34*a*.

The output of the engine 16 is transmitted through a crankshaft and a drive shaft (neither shown) to a clutch 36 of the outboard engine 10 located below the water surface. The clutch 36 is connected to a propeller 40 through a propeller shaft (not shown).

The clutch 36, which comprises a conventional gear mechanism, is omitted from the drawing. It is composed of a drive gear that rotates unitarily with the drive shaft when the engine 16 is running, a forward gear, a reverse gear, and a dog (sliding clutch) located between the forward and reverse gears that rotates unitarily with the propeller shaft. The forward and reverse gears are engaged with the drive gear and rotate idly in opposite directions on the propeller shaft.

The ECU 22 is responsive to the output of the neutral switch 34 received on the signal cable 34*a* for driving an actuator (electric motor) 42 via a drive circuit (not shown) so as to realize the intended shift position. The actuator 42 drives the dog through a shift rod 44.

When the shift lever 32 is put in Neutral, the engine 16 and the propeller shaft are disconnected and can rotate independently. When the shift lever 32 is put in Forward or Reverse position, the dog is engaged with the forward gear or the reverse gear and the rotation of the engine 16 is transmitted through the propeller shaft to the propeller 40 to drive the propeller 40 in the forward direction or the opposite (reverse) direction and thus propel the boat 12 forward or backward.

The engine 16 will now be explained with reference to FIGS. 3 and 4.

Figure 3:
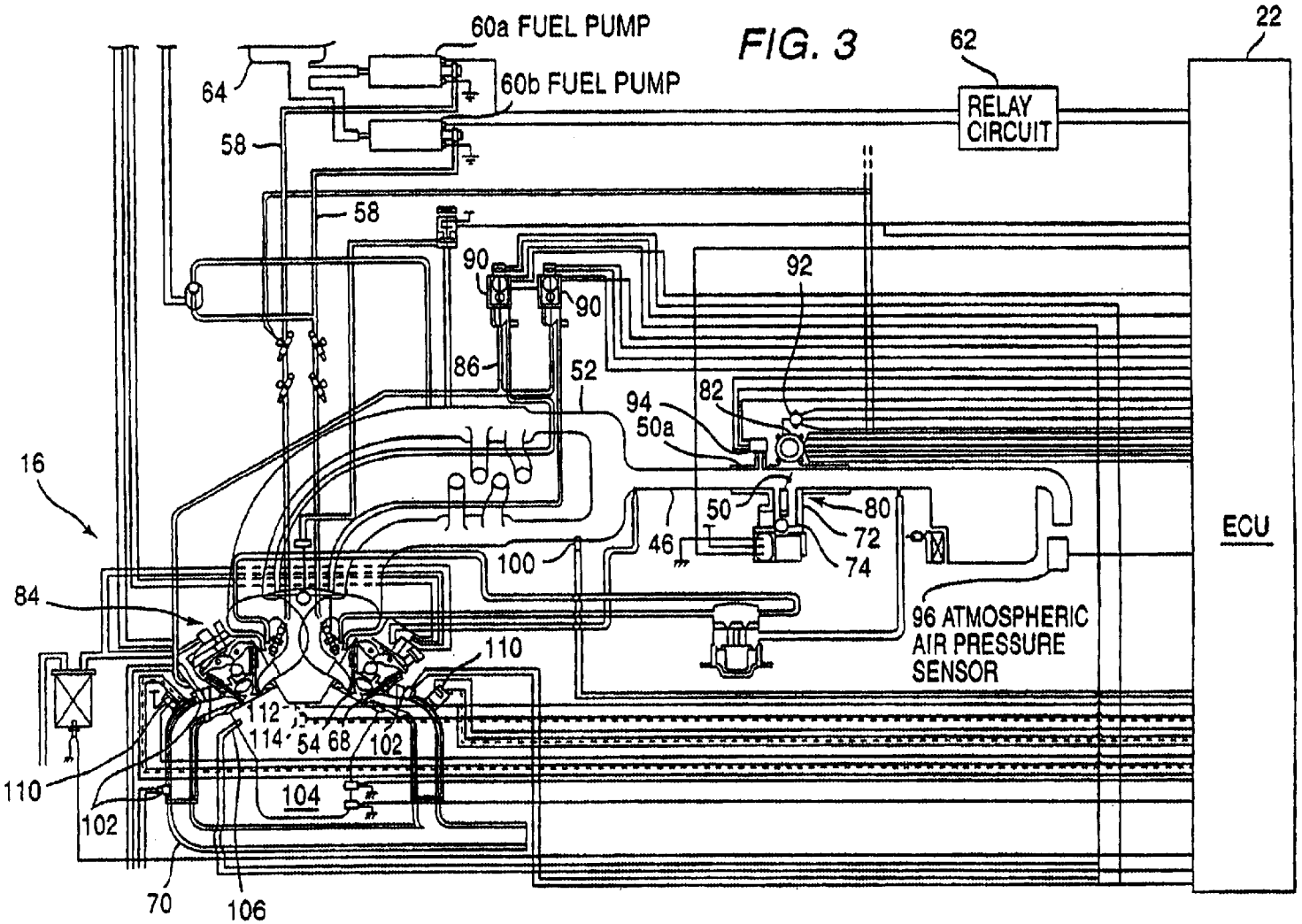
FIG. 3 is a schematic diagram showing details of the engine of the outboard motor shown in FIG. 1.

As shown in FIG. 3, the engine 16 is equipped with an air intake pipe 46. Air drawn in through an air cleaner (not shown) is supplied to intake manifolds 52 provided one for each of left and right cylinder banks disposed in V-like shape as viewed from the front, while the flow thereof is adjusted by a throttle valve 50, and finally reaches intake valves 54 of the respective cylinders. A fuel injector 56 (not shown in FIG. 3) is installed in the vicinity of each intake valve (not shown) for injecting fuel (gasoline).

The fuel injectors 56 are connected through two fuel pipes 58 provided one for each cylinder bank to a fuel tank (not shown) containing gasoline. The fuel pipes 58 is provided with separate fuel pumps 60*a* and 60*b* equipped with electric motors (not shown) that are driven via a relay circuit 62 so as to send pressurized gasoline to the fuel injectors 56. Reference numeral 64 designates a vaporized fuel separator.

The intake air is mixed with the injected gasoline to form an air-fuel mixture that passes into the combustion chamber (not shown) of each cylinder, where it is ignited by a spark plug 66 (not shown in FIG. 3) to bum explosively and drive down a piston (not shown). The so-produced engine output is taken out through the crankshaft. The exhaust gas produced by the combustion passes out through exhaust valves 68 into exhaust manifolds 70 provided one for each cylinder bank and is discharged to the exterior of the engine 16.

As illustrated in FIG. 3, a branch passage 72 for secondary air supply is formed to branch off from the air intake pipe 46 upstream of the throttle valve 50 and rejoin the air intake pipe 46 downstream of the throttle valve 50. The branch passage 72 is equipped with an electronic secondary air control valve (EACV) 74. The EACV 74 is connected to the ECU 22. As explained further later, the ECU 22 calculates a current command value and supplies the same to the EACV 74 so as to drive the EACV 74 for regulating the opening of the branch passage 72. The branch passage 72 and the EACV 74 thus constitute a secondary air supplier 80 for supplying secondary air in proportion to the opening of the EACV 74.

The throttle valve 50 is connected to an actuator (stepper motor) 82. The actuator 82 is connected to the ECU 22. The ECU 22 calculates a current command value proportional to the output of the throttle lever position sensor 30 and supplies it to the actuator 82 through a drive circuit (not shown) so as to regulate the throttle opening or position TH. More specifically, the actuator 82 is directly attached to a throttle body 50*a* housed in the throttle valve 50 with its rotating shaft (not shown) oriented to be coaxial with the throttle valve shaft. In other words, the actuator 82 is attached to the throttle body 50*a* directly, not through a linkage, so as to simplify the structure and save mounting space. Thus, in this embodiment, the push cable is eliminated and the actuator 82 is directly attached to the throttle body 50*a* for driving the throttle valve 50.

The engine 16 is provided in the vicinity of the intake valves 74 and the exhaust valves 68 with a variable valve timing system 84. When engine speed and load are relatively high, the variable valve timing system 84 switches the valve open time and the amount of lifting to relatively large values (Hi V/T). When the engine speed and load are relatively low, it switches the valve open time and the amount of lifting to relatively small values (Lo V/T).

The exhaust system and the intake system in each bank of the engine 16 are connected by an EGR (Exhaust Gas Recirculation) pipe 86 provided therein with an EGR control valve 90. Under prescribed operating conditions, a portion of the exhaust gas is returned to the air intake system.

The actuator 82 is connected to a throttle position sensor 92 responsive to rotation of the throttle valve shaft for outputting a signal proportional to the throttle opening or position TH. A manifold absolute pressure sensor 94 is installed downstream of the throttle valve 50 for outputting a signal proportional to the manifold absolute pressure PBA in the air intake pipe (i. e., engine load). In addition, an atmospheric air pressure sensor 96 is installed near the engine 16 for outputting a signal proportional to the atmospheric pressure PA.

An intake air temperature sensor 100 is installed downstream of the throttle valve 50 and outputs a signal proportional to the intake air temperature TA. Three overheat sensors 102 installed in the exhaust manifolds 70 of the left and right cylinder banks output signals proportional to the engine temperature. A coolant temperature sensor 106 installed at an appropriate location near the cylinder block 104 outputs a signal proportional to the engine coolant temperature TW. $O_2$ sensors 110 are installed in the exhaust manifolds 70 and output signals reflecting the oxygen concentration of the exhaust gas.

A first oil pressure switch 112 and a second oil pressure switch 114 are installed at a hydraulic circuit (not shown) for supplying engine oil (lubricant) to the engine 16, in the vicinity of the V-bank of the engine 16 and generates ON/OFF signal in response to the oil pressure PO in the hydraulic circuit. The outputs of the switches 112, 114 are sent to the ECU 22.

Figure 4:
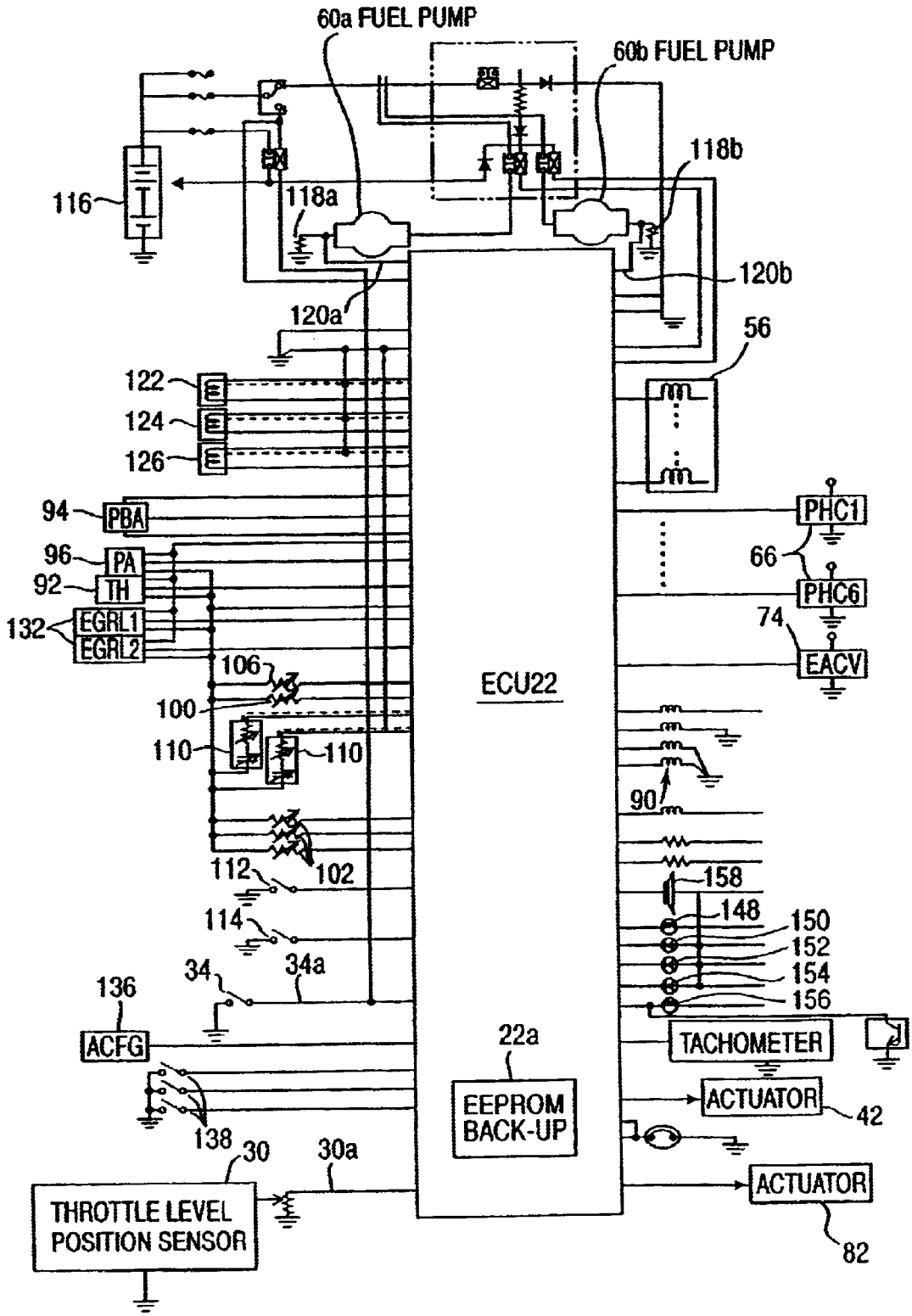
FIG. 4 is a block diagram showing the particulars of inputs/outputs to and from an electronic control unit (ECU) shown in FIG. 1.

The explanation of the outputs of the sensors and the inputs/outputs to/from the ECU 22 will be continued with reference to FIG. 4. Some sensors and signals lines do not appear in FIG. 3.

The motors of the fuel pumps 60*a* and 60*b* are connected to an onboard battery 116 and detection resistors 118*a* and 118*b* are inserted in the motor current supply paths. The voltages across the resistors are inputted to the ECU 22 through signal lines 120*a* and 120*b*. The ECU 22 determines the amount of current being supplied to the motors from the voltage drops across the resistors and uses the result to discriminate whether any abnormality is present in the fuel pumps 60*a* and 60*b*.

TDC (Top Dead Center) sensors 122 and 124 and a crank angle sensor 126 are installed near the engine crankshaft for producing and outputting to the ECU 22 cylinder discrimination signals, crank angle signals near the top dead centers of the pistons, and a crank angle signal once every 30 degrees. The ECU 22 calculates the engine speed NE from the output of the crank angle sensor. A lift sensor 132 is installed near the EGR control valve 90 and produces and sends to the ECU 22 signals related to the amount of lifting (valve openings) of the EGR control valves 90.

The output of the F-terminal (ACGF) 136 of an AC generator (not shown) is input to the ECU 22. Three oil pressure (hydraulic) switches 138 are installed in the hydraulic circuit (not shown) of the variable valve timing system 84 and produce and output to the ECU 22 signals related to the detected oil pressure.

The ECU 22, which is composed of a microcomputer as mentioned earlier, is equipped with an EEPROM (Electrically Erasable and Programmable Read-Only Memory) 22*a* for back-up purposes. The ECU 22 uses the foregoing inputs to carry out processing operations explained later. It also turns on a PGM lamp 148 when the PGM (program/ECU) fails, an overheat lamp 150 when the engine 16 overheats, an oil pressure (hydraulic) lamp 152 when the oil pressure becomes abnormal (explained later), a pressure switch failure lamp 154 when at least one of the first and second oil pressure switches 112, 114 fails, and an ACG lamp 156 when the AC generator fails. Together with lighting these lamps it sounds a buzzer 158.

Explanation will not be made with regard to other components appearing in FIG. 4 that are not directly related to the substance of this invention.

The operation of the oil pressure switch failure detection system for an outboard motor according to the embodiment will now be explained.

For ease of understanding, an operation of abnormal oil pressure detection using the first and second oil pressure switches 112, 114 on the basis of which the oil pressure switch failure detection system according to the embodiment of the present invention is conducted, will first be explained.

Figure 5:
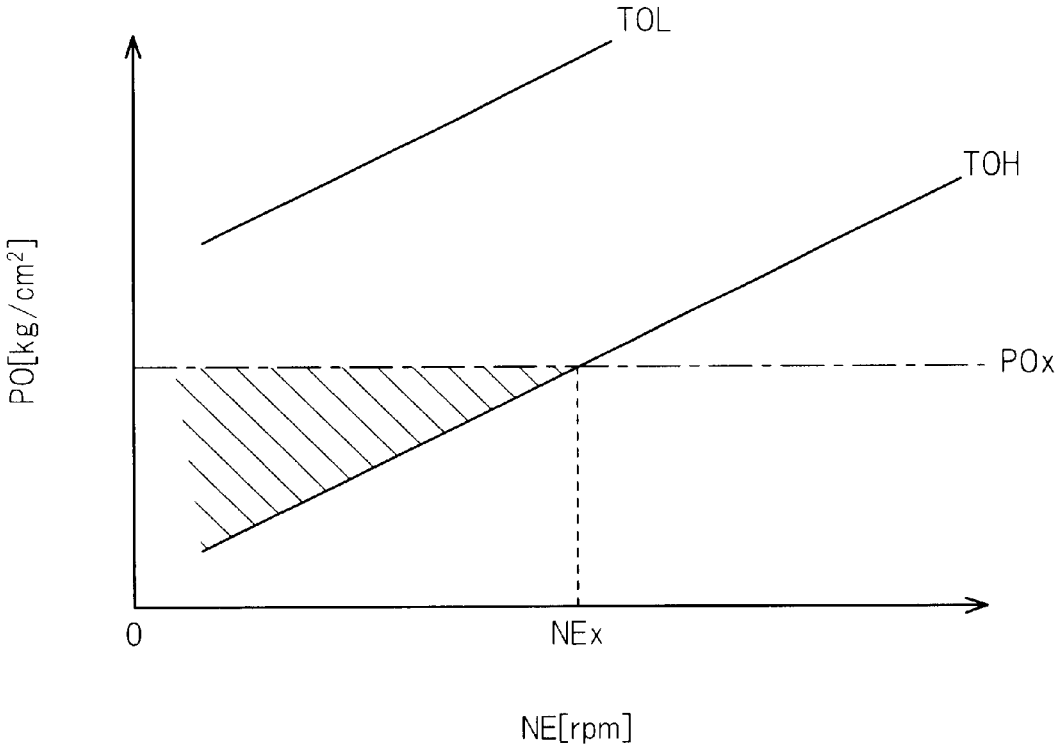

FIG. 5 is a graph showing the oil pressure PO with respect ot the engine speed NE and the oil temperature TO.

Generally the pressure of engine oil (lubricant) PO generally varies with the engine speed NE and the oil temperature TO, as illustrated. In the figure, a straight line indicated as "TOL" illustrates the characteristic of oil pressure under low oil temperature, while another straight line indicated as "TOH" shows that under high oil temperature. As will be seen from the figure, the oil pressure PO decreases with decreasing engine speed NE.

For that reason, supposing that a single oil pressure switch is used and generates an ON signal when the oil pressure drops below a predetermined point of operation (illustrated as "POx" in the figure), to alarm the occurrence of engine oil abnormality, i.e., insufficient oil pressure, even if the oil pressure falls below POx, the oil pressure is still sufficient in the hatched portion (below the engine speed NEx and above the high pressure characteristic TOH). Thus, if only one switch is used, it becomes impossible to detect the oil pressure abnormality at the low engine speed region When the amount of oil is, in fact, extremely insufficient due to leakage, missing of addition, etc., it should necessarily be alarmed promptly. However, the output of the oil pressure switch remains unchanged until the engine speed drops below the level for the reason mentioned above. On the other hand, if the operating point of the oil pressure switch is set to a lower pressure so as to detect the oil pressure abnormality at a low engine speed, it becomes impossible to detect accurately the oil pressure abnormality at a high engine speed.

Further, as illustrated in the figure, the characteristics are different for different oil temperatures. Since the oil viscosity decreases with increasing oil temperature, the characteristic under high temperature is lower than that under low temperature when the engine speed NE is same. If no attention is paid for the oil pressure relative to temperature in determining the operating point of the oil pressure switch, when the oil pressure drops due to the oil temperature increases, the detection and alarming may sometimes be erroneous.

Accordingly, in this embodiment, the first oil pressure switches 112 having operating point set at a lower pressure and the second oil pressure switch 114 having operating point set at a higher pressure are provided in such a way that the engine speed NE and oil temperature TO can be taken into account, thereby enabling to detect the occurrence of abnormality in the oil pressure accurately under any engine speeds and oil temperatures with accuracy.

Figure 6:
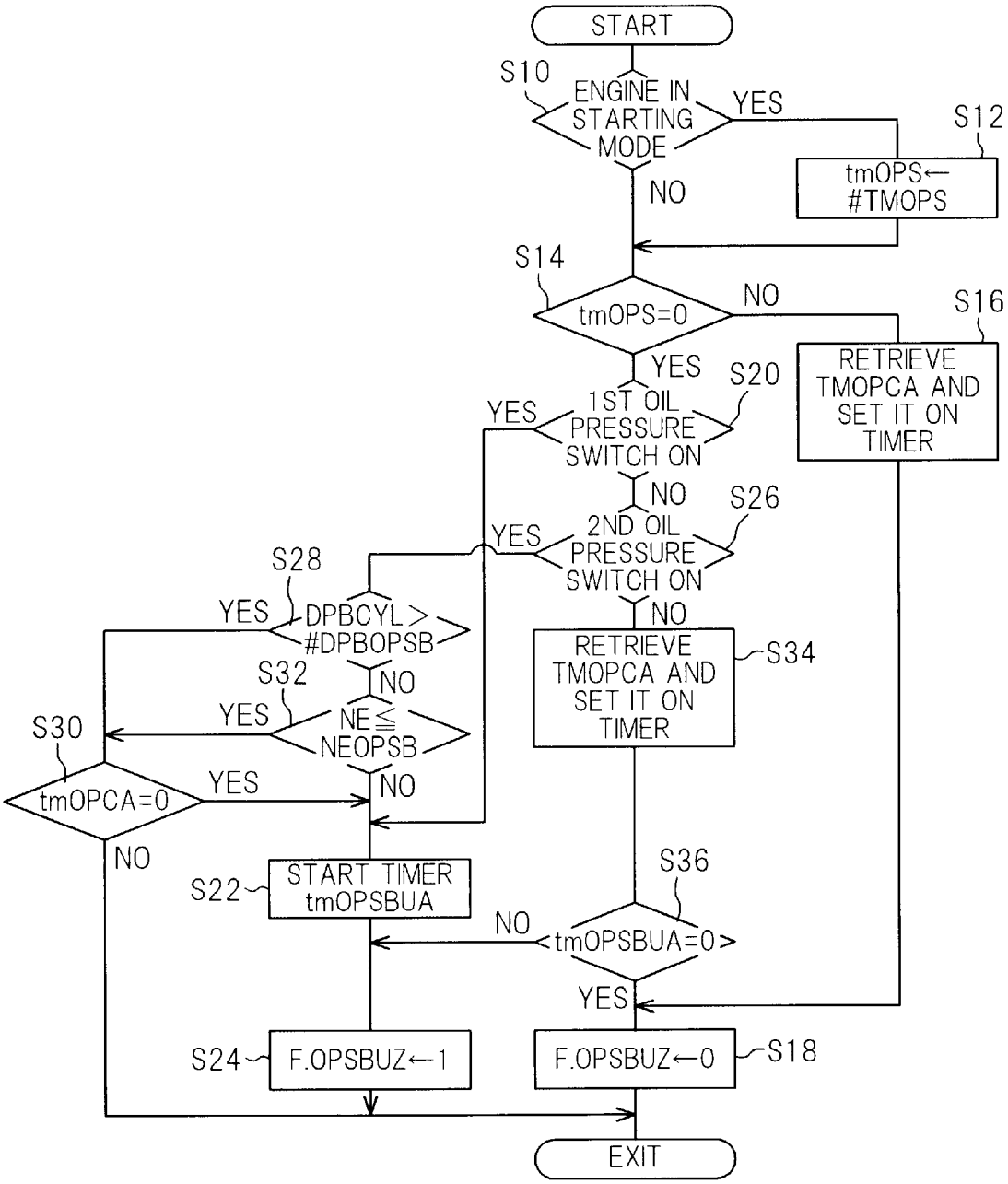
FIG. 6 is a flow chart showing an operation of abnormal oil pressure detection using the oil pressure switches (whose operating points are illustrated in the graph of FIG. 5) which is the base of the oil pressure switch failure detection system according to the embodiment of the present invention.

FIG. 6 is a flow chart showing the operation of the abnormal oil pressure detection or determination in the operation. The illustrated program is executed once every 100 msec, for example.

The program begins in S10 in which it is determined whether the engine 16 is in a starting mode (or the engine 16 has stalled). This is done by determining whether the detected engine speed NE has reached an engine-starting speed (e.g., 500 rpm).

When the result is affirmative, the program proceeds to S12 in which an oil-pressure-abnormality-detection-cancel timer (down-counter) tmOPS is set with a prescribed value #TMOPS to start the same to begin counting down (i.e., time measurement).

When the result in S10 is negative or when the program proceeds to S12, the program then proceeds to S14 in which it is determined whether the value of the oil-pressure-abnormality-detection-cancel timer tmOPS has reached zero. The timer tmOPS is provided for prohibiting the abnormal oil pressure detection (determination) and alarming for a predetermined period of time (corresponding to the prescribed value #TMOPS) since engine starting.

When the result in S14 is negative, the program proceeds to S16 in which a value TMOPCA is retrieved from a table (whose characteristic is illustrated in FIG. 6) by the detected engine coolant temperature TW, and the retrieved value is set on an oil-pressure-abnormality-determination-delay timer (down-counter) tmOPCA to start the same to begin time measurement. As illustrated in FIG. 6, the value TMOPCA is set to be increased with increasing engine coolant temperature TW. The reason for this will be explained later.

The program proceeds to S18 in which the bit of a buzzer-operation-permission flag F.OPSBUZ is reset to 0, and the program is once terminated. To reset the bit of the flag F.OPSBUZ to 0 indicates not to operate (sound) the buzzer 158, while to set that to 1 indicates to operate the same so as to effect alarming.

In the next or later program loop, when the result in S14 is affirmative, the program proceeds to S20 in which it is determined whether the first oil pressure switch 112 generates the ON signal.

Before continuing the explanation of the flow chart in FIG. 6, the operations of the first and second oil pressure switches 112, 114 will be explained with reference to FIG. 8.

In this embodiment, the first oil pressure switch 112 is configured to generate the OFF signal when the engine oil pressure PO is greater than a first predetermined oil pressure PO1 (indicating the operation point) and to generate the ON signal when the engine oil pressure PO is less than or equal to the first predetermined oil pressure PO1. The second oil pressure switch 114 is configured to generate the OFF signal when the engine oil pressure PO is greater than a second predetermined oil pressure PO2 (similarly indicating the operation point) and to generate the ON signal when the engine oil pressure PO is less than or equal to the second predetermined oil pressure PO2.

Further, as mentioned above, oil pressure drop due to oil temperature rise may lead to erroneous detection. In view of this, in this embodiment, the predetermined first and second oil pressures PO1, 2 (each indicating the operating point) are set relative to a (possible) maximum oil temperature under which the engine 16 has been completely warmed up, more specifically, are set relative to a characteristic set based on a (possible) maximum oil temperature TOmax. The characteristic is set to be increased with increasing engine speed NE. This can surely avoid erroneous detection if the engine oil pressure drops due to temperature rise.

Further, the first predetermined oil pressure PO1 is set to a value corresponding to a minimum engine speed NEmin (at or close to an idling engine speed, e.g., 500 rpm) relative to the engine speed NE in accordance with the characteristic of the maximum oil temperature TOmax. Specifically, the first predetermined oil pressure PO1 is set to be 0.3 kg/cm$^2$. In other words, the first predetermined oil pressure PO1 is set to be a (possible) minimum oil pressure under normal operating condition of the engine 16. With this, it becomes possible to promptly detect an abnormal oil decrease due to leakage, missing of addition, etc.

Further, the second predetermined oil pressure PO2 is set to a value corresponding to full load (at high engine speed and high engine load). Specifically, the second predetermined oil pressure PO2 is set to a value corresponding to a high engine speed (more precisely, 2500 rpm) relative to the engine speed NE in accordance with the characteristic of maximum oil temperature TOmax. More specifically, it is set to be 2.2 kg/cm$^2$. With this, it becomes possible to detect the abnormal oil pressure at a high engine speed and a high engine load, thereby ensuring to protect the engine 16 from being damaged by sticking or wear due to metal-to-metal contact.

Returning to the explanation of the flow chart of FIG. 6, when the result in S20 is affirmative, since this indicates the oil pressure becomes abnormal (low), the program proceeds to S22 in which a prescribed value is set on a buzzer-operation-termination timer (down-counter) tmOPSBUA to start time measurement, to S24 in which the bit of the buzzer-operation-permission flag F.OPSBUZ is set to 1 to operate (sound) the buzzer 158 so as to effect alarming. At the same time, the oil pressure lamp 152 is turned on. Then, the program is once terminated.

On the other hand, when the result in S20 is negative, the program proceeds to S26 in which it is determined whether the second oil pressure switch 114 generates the ON signal, in other words, it is determined whether the oil pressure PO is less than or equal to the second predetermined oil pressure PO2. When the result is affirmative, the program proceeds to S28 in which a change DPBCYL of the manifold absolute pressure PBA is greater than a predetermined amount #DPBOPSB. The change DPBCYL indicates the difference between the manifold absolute pressure PBA detected at the last cycle (last program loop) and that detected at the current cycle (program loop).

Figure 9:
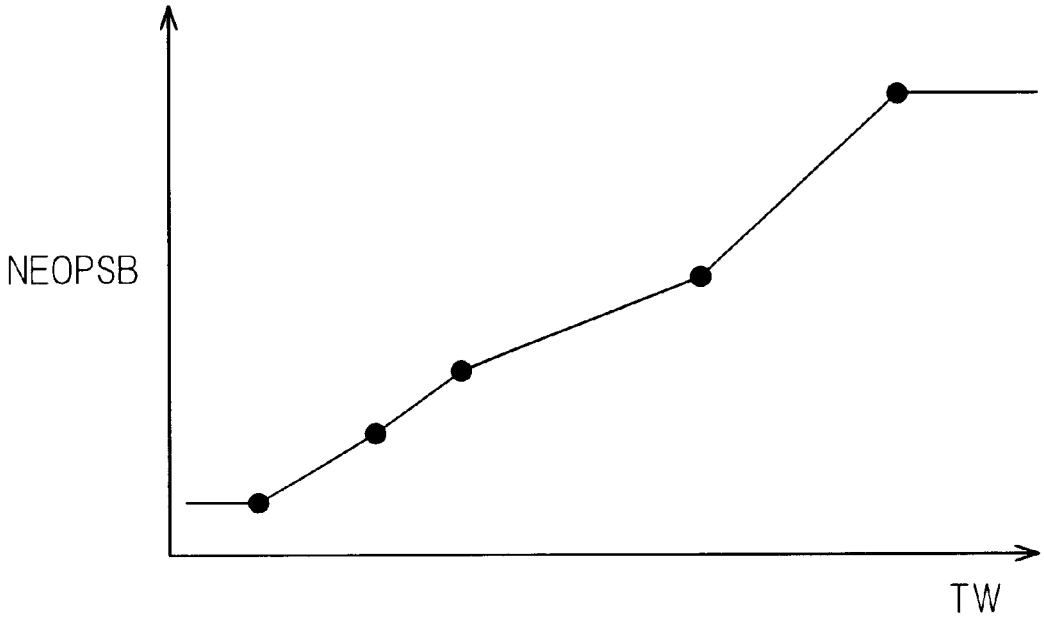
FIG. 9 is a graph showing a predetermined engine speed NEOPSB set relative to the engine coolant temperature and referred to in the flow chart of FIG. 6.

When the result in S28 is affirmative, since this indicates that the engine 16 is under transient operating condition, the program proceeds to S30 in which it is determined whether the value of the oil-pressure-abnormality-determination-delay timer tmOPCA has reached zero. On the other hand, when the result in S28 is negative, since this indicates that the engine 16 is under normal operating condition such as cruising, the program proceeds to S32 in which it is determined whether the detected engine speed NE is less than or equal to a predetermined engine speed NEOPSB. FIG. 9 shows the characteristic of the predetermined engine speed NEOPSB. As illustrated, the speed NEOPSB is set to be increased with increasing engine coolant temperature TW and is calculated by retrieving a table (prepared beforehand based on this illustrated characteristic) using the detected engine coolant temperature TW.

Explaining this, the oil temperature TO rises as the engine speed NE increases. Since the engine coolant temperature TW rises in this situation also, the relationship between the engine speed NE and the oil temperature TO can accordingly be replaced by a relationship between the engine speed NE and the engine coolant temperature TW. Further, as illustrated in FIG. 8, there exists a certain proportional relationship between the engine speed NE and the oil pressure PO.

Thus, it becomes possible to accurately determine whether the oil pressure PO is low even at an engine speed region below the engine speed NEOPSB (based on which the second predetermined oil pressure PO2 is set; e.g., 2500 rpm), by comparing the detected engine speed NE with the engine speed NEOPSB (which is predetermined with respect to the detected engine coolant temperature TW).

The determination in S32 will further be explained with reference to FIG. 8.

If the oil pressure PO is less than the second predetermined oil pressure PO2 when the oil temperature TO is at the maximum oil temperature TOmax (i.e., if the result in S26 is affirmative) and the detected engine speed NE is NEA (marked by "A" in the figure) which is higher than the engine speed NEOPSB (2500 rpm, for example), the result in S32 is negative and since this indicates the oil pressure is low, the program proceeds to S22 in which the timer tmOPSBUA is set with a prescribed value to start time measurement, and to S24 in which the bit of the flag F.OPSBUZ is set to 1 to operate (sound) the buzzer 158 to effect alarming.

Alternative, if the oil pressure PO is similarly less than the second predetermined oil pressure PO2 when the oil temperature TO is at the maximum oil temperature TOmax (i.e., if the result in S26 is affirmative) but the detected engine speed NE is less than the engine speed NEOPSB (as marked by "A'" and "B" in the figure), the result in S32 is affirmative and the program proceeds to S30 in which it is determined whether the value of the timer tmOPCA has reached zero. Unless the result is affirmative, the program is immediately terminated and the following procedures are skipped.

Thus, the timer tmOPCA is configured such that the oil pressure is determined to be abnormal (i.e., low) only when the output state of the second oil pressure switch 114 is kept unchanged for a predetermined period (corresponding to the value TMOPCA). With this, as illustrated in a time chart shown in FIG. 10, if the oil pressure PO temporarily drops below the second predetermined oil pressure PO2, it can prevent such a transient situation from being detected as abnormal, thereby surely avoiding the audio alarming by the buzzer 158 and the implementation of oil pressure alarming explained later.

In the flow chart of FIG. 6, when the result in S30 is affirmative, since this indicates that the oil pressure is determined to be abnormal (low), the program proceeds to S22 and S24.

Further, another situation where the oil pressure PO is less than the second predetermined oil pressure PO2 due to engine speed decrease, but is still the characteristic of TOmax (not abnormal) as marked by "A'" in the figure, or still another situation where the oil pressure PO is less than PO2 and is abnormal (low) as marked by "B" in the figure, will be explained.

The change of the oil pressure PO lags behind the change of the engine speed NE. Specifically when the engine speed NE drops, the oil pressure PO drops also. Since, however, the oil temperature TO will drop due to the engine speed decrease, the oil pressure PO will then turn to an increasing direction. In this case, since the oil pressure returns to a high level and hence the result in S26 becomes negative, the program does not proceed to S30 and hence, the oil pressure PO will not be determined to be abnormal. On the other hand, when the oil pressure PO is, in fact, abnormal (low), since it will not return to a sufficient level, the oil pressure PO will be determined to be abnormal when the result in S30 becomes affirmative.

In the embodiment, as mentioned above, the oil pressure is immediately determined to be abnormal (low) from the output (ON signal) of the second oil pressure switch 114, when it can be judged from the manifold absolute pressure PBA and the engine speed NE that the oil pressure is abnormal, while the determination is delayed until the output of the switch 114 is kept unchanged for the predetermined period (corresponding to the timer value TMOPCA) when the oil pressure is likely to return to a sufficient state. With this, it becomes possible to accurately detect and alarm the abnormality in the oil pressure throughout entire engine speeds and the oil temperatures, thereby ensuring to avoid engine sticking or wear due to metal-to-metal contact.

Figure 7:
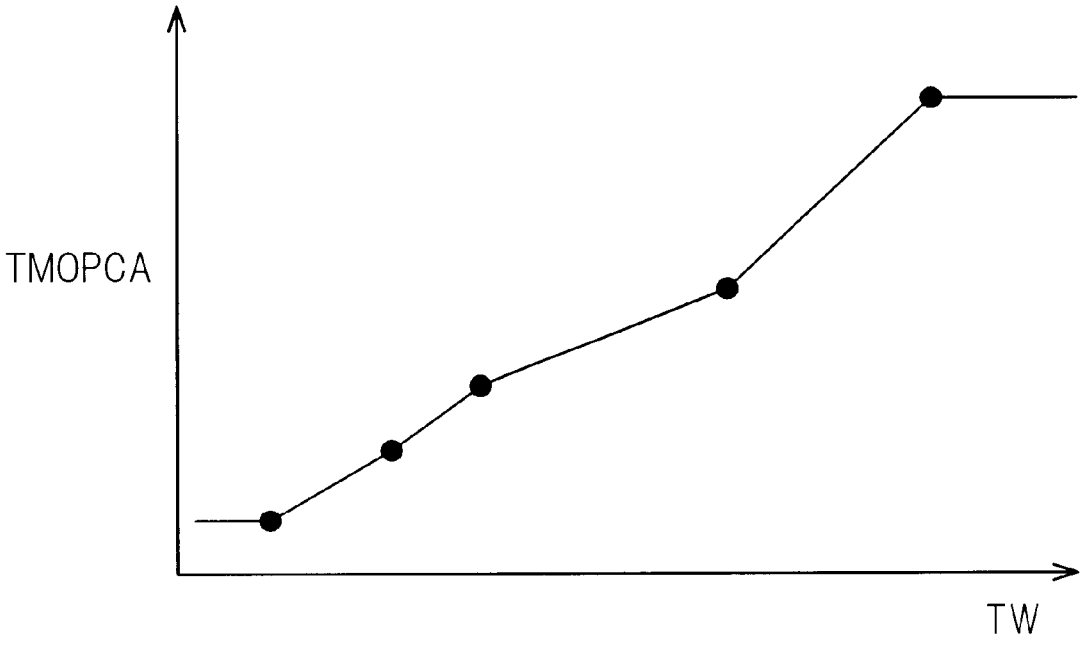
FIG. 7 is a graph showing the characteristic of a timer value TMOPCA set relative to the engine coolant temperature TW to be referred to in the flow chart of FIG. 6.

Furthermore, the timer value TMOPCA is set to be increased with increasing engine coolant temperature TW as illustrated in FIG. 7. This is because the oil pressure PO drops as the engine coolant temperature TW (and hence the oil temperature TO) increases and a period of time necessary for the oil pressure returns to the second predetermined oil pressure PO2 increases as the engine coolant temperature TW increases. By setting the characteristic of the timer value as shown in FIG. 7, the erroneous detection can be avoided more surely.

Returning to the explanation of the flow chart of FIG. 6, when the result in S26 is negative, since this indicates that the oil pressure PO is not low, the program proceeds to S34 in which the value TMOPCA is retrieved and is set on the timer tmOPCA to start time measurement. The program then proceeds to S36 in which it is determined whether the value of the buzzer-operation-termination timer tmOPSBUA has reached zero. The buzzer-operation-termination timer tmOPSBUA is thus configured such that the oil pressure is determined to be not abnormal when the non-abnormal state is kept unchanged for the predetermined period (corresponding to TMOPCA). This can avoid erroneous detection in a situation where the oil pressure PO exceeds temporarily the second predetermined oil pressure PO2 for a short period of time, as illustrated in the time chart of FIG. 10.

When the result in S36 is negative, the program proceeds to S24 in which the operation of the buzzer 158, i.e., the audio alarming is continued. On the other hand, when the result in S36 is affirmative, the program proceeds to S18 in which the bit of the buzzer-operation-permission flag F.OPSBUZ is reset to 0 such that the operation of the buzzer 158 is terminated.

Next, other operation of the oil pressure warning system for an outboard motor according to the embodiment, i.e., alarming succeeding to the abnormality detection will be explained.

Figure 11:
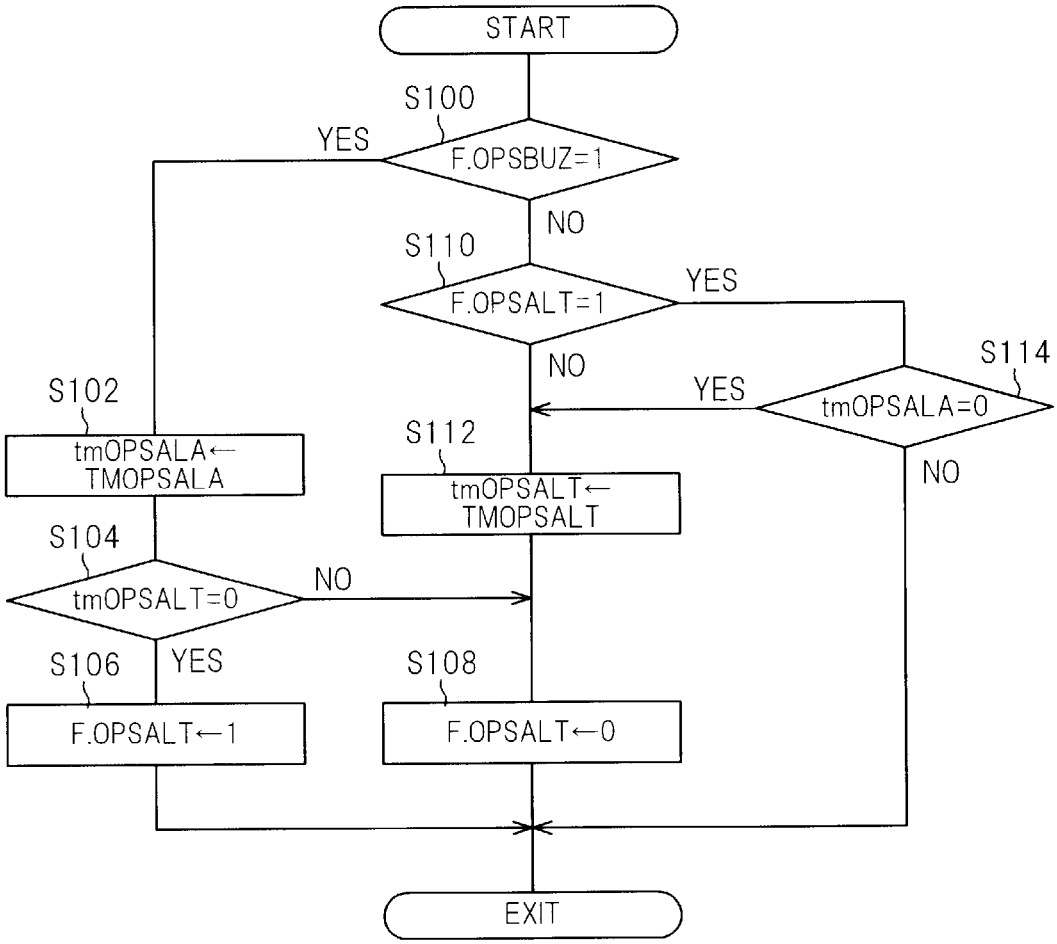
FIG. 11 is a flow chart showing the operation of alarming to be conducted upon detection of the abnormal oil pressure using the oil pressure switches which are subject of the oil pressure switch failure detection system according to the embodiment of the present invention.

FIG. 11 is a flow chart showing the alarming succeeding to the oil pressure abnormality detection. The illustrated program is similarly executed once every 100 msec, for example.

The program begins in S100 in which it is determined whether the bit of the buzzer-operation-permission flag F.OPSBUZ is set to 1, and when the result is affirmative, since this indicates that the oil pressure is abnormal, the program proceeds to S102 in which a prescribed value TMOPSALA is set on an oil-pressure-alarm-retumdelay timer tmOPSALA (explained later) to start the same.

The program then proceeds to S104 in which it is determined whether the value of an oil-pressure-alarm-execution-delay timer tmOPSALT has reached zero. The timer is started at a step explained below and is a counter (down-counter) to count down or measure a time interval from the buzzer operation (oil pressure abnormality determination) to the initiation of "DECREASING" of the engine speed (illustrated in the time chart of FIG. 10).

When the result in S104 is affirmative, the program proceeds to S106 in which the bit of an oil-pressure-alarm-permission flag F.OPSALT is set to 1 to execute the oil pressure alarming. To set the bit of the flag F.OPSALT to 1 indicates to execute the oil pressure alarming, while to reset it to 0 indicates not to execute the oil pressure alarming. When the result in S104 is negative, the program proceeds to S108 in which the bit of the flag F.OPSALT is reset to 0.

On the other hand, when the result in S100 is negative, the program proceeds to S110 in which it is determined whether the bit of the flag F.OPSALT is set to 1. When the result is negative, the program proceeds to S112 in which the prescribed value TMOPSALT is set on the timer tmOPSALT to start the same, and proceeds to S108. When the result in S110 is affirmative, the program proceeds to S114 in which it is determined whether the value of the timer tmOPSALA has reached zero. The timer is a counter (down-counter) to count down or measure a time interval from the termination of buzzer operation (i.e., the oil pressure abnormality is eliminated) to the initiation of "RETURNING" of the engine speed (illustrated in the time chart of FIG. 9). When the result in S114 is affirmative, the program proceeds to S112. When the result in S114 is negative, the program is immediately terminated.

Figure 10:
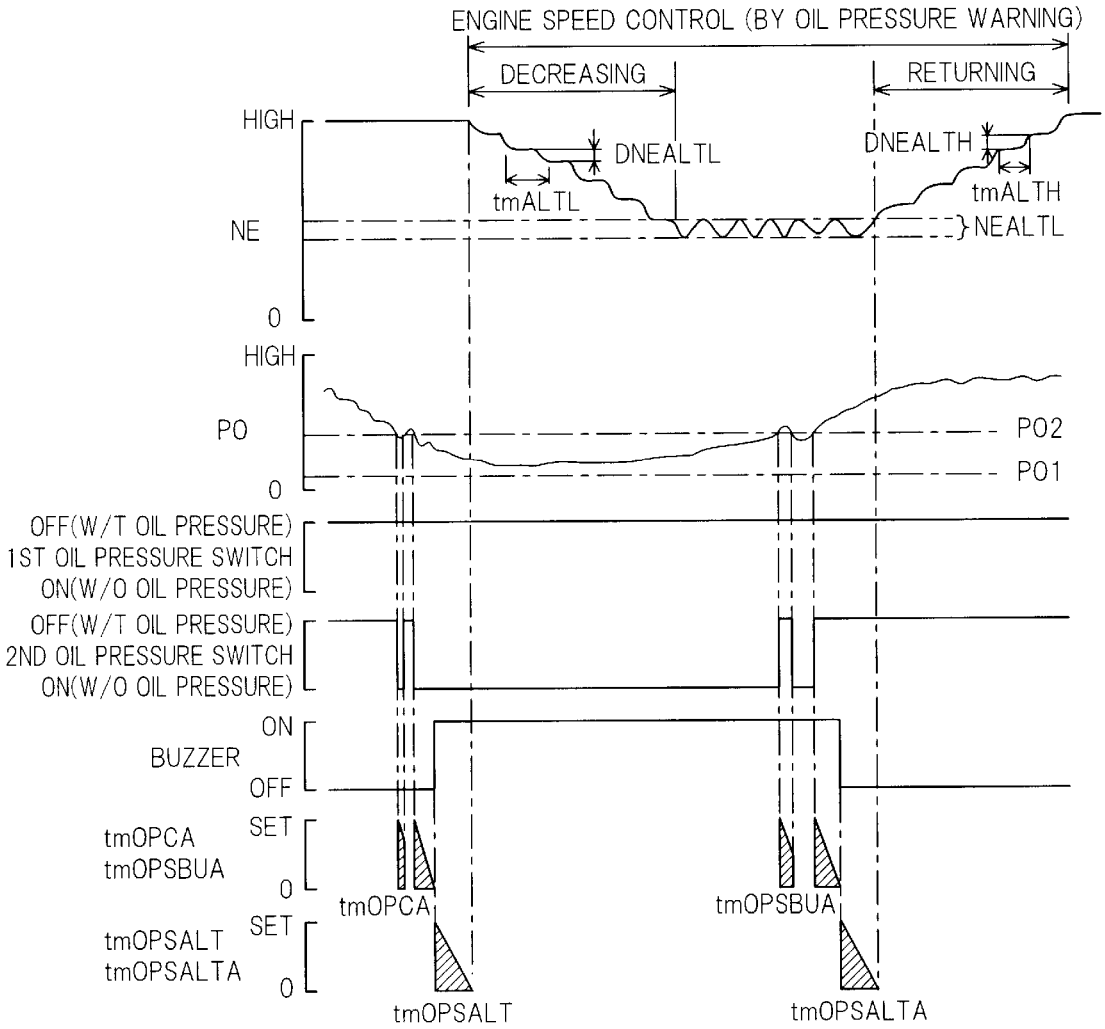
FIG. 10 is a time chart showing the processing in the flow chart of FIG. 6.

This oil pressure alarming will again be explained with reference to the time chart of FIG. 10.

When the bit of the flag F.OPSALT is set to 1, the engine speed decreasing control is conducted in a routine (not shown) by cutting off the fuel supply and ignition to the engine 16 such that the engine speed NE decreases stepwise by a prescribed amount DNEALTL at every unit period of time tmALTL. When the engine speed has dropped to a predetermined engine speed NEALTL at which the engine 16 is not likely to be damaged due to metal-to-metal contact, the engine speed NE is kept at this speed NEALTL until the bit of the flag F.OPSALT is reset to 0.

when the bit of the flag F.OPSALT is reset to 0, the control is shifted to a mode of engine speed returning (increasing) in which the engine speed NE is increased stepwise to a level required by the operator by a prescribed amount DNEALTH at every unit period of time tmALTH.

Now, based on the above, the operation of the oil pressure switch failure detection system for an outboard motor according to the embodiment of the present invention will be explained.

Figure 12:
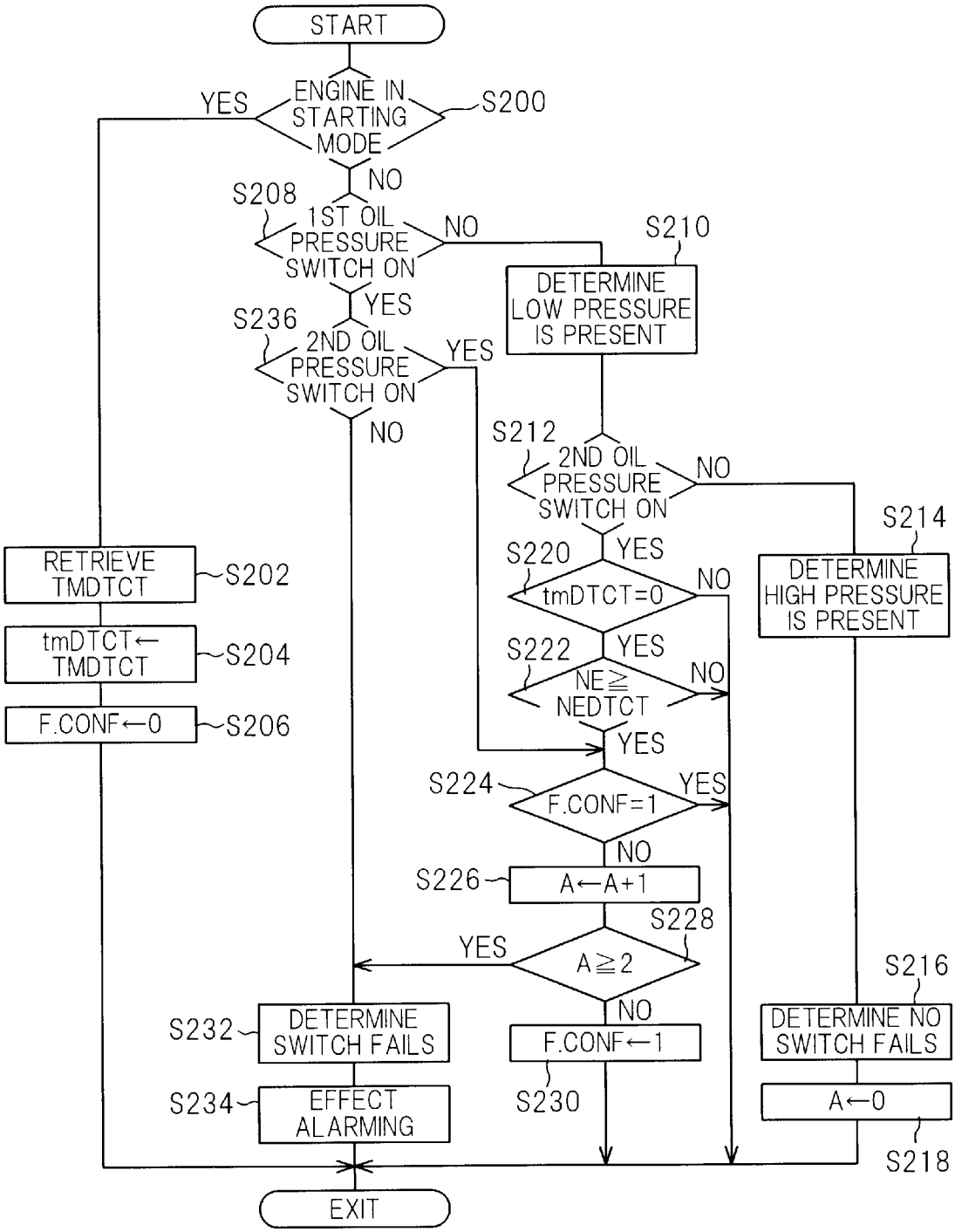
FIG. 12 is a flow chart showing the operation of the oil pressure switch failure detection system for an outboard motor according to the embodiment of the present invention.

FIG. 12 is a flow chart showing this. The illustrated program is similarly executed once every 100 msec, for example.

The program begins in S200 in which it is determined whether the engine 16 is in the starting mode (or the engine 16 has stalled). This is done by determining whether the detected engine speed NE has reached an engine-starting speed (e.g., 500 rpm) in the same manner as that of S10 in the flow chart of FIG. 6.

When the result in S200 is affirmative, the program proceeds to S202 in which a timer value TMDTCT is retrieved from table data using the engine speed NE or manifold absolute pressure PBA, and proceeds to S204 in which the retrieved timer value TMDTCT is set on a failure-detection-execution timer (down-counter) tmDTCT to start time measurement. The counter tmDTCT is used to determine whether or not failure detection of the second oil pressure switch 114 should be executed. This failure detection is suspended until the timer value has reached zero.

Explaining this, since the pressure of engine oil varies with the oil temperature TO as mentioned above, it is preferable to check the outputs of the second oil pressure switch 114 during a period in which the oil temperature TO is within a certain range. For this reason, the checking to be conducted after a predetermined period of time (corresponding to the timer value TMDTCT) has passed since starting of the engine 16, in other word, it is to be conducted after the oil temperature TO has risen to a prescribed temperature level. With this, it becomes possible to avoid erroneous switch failure detection of the second oil pressure switch 114.

Figure 8:
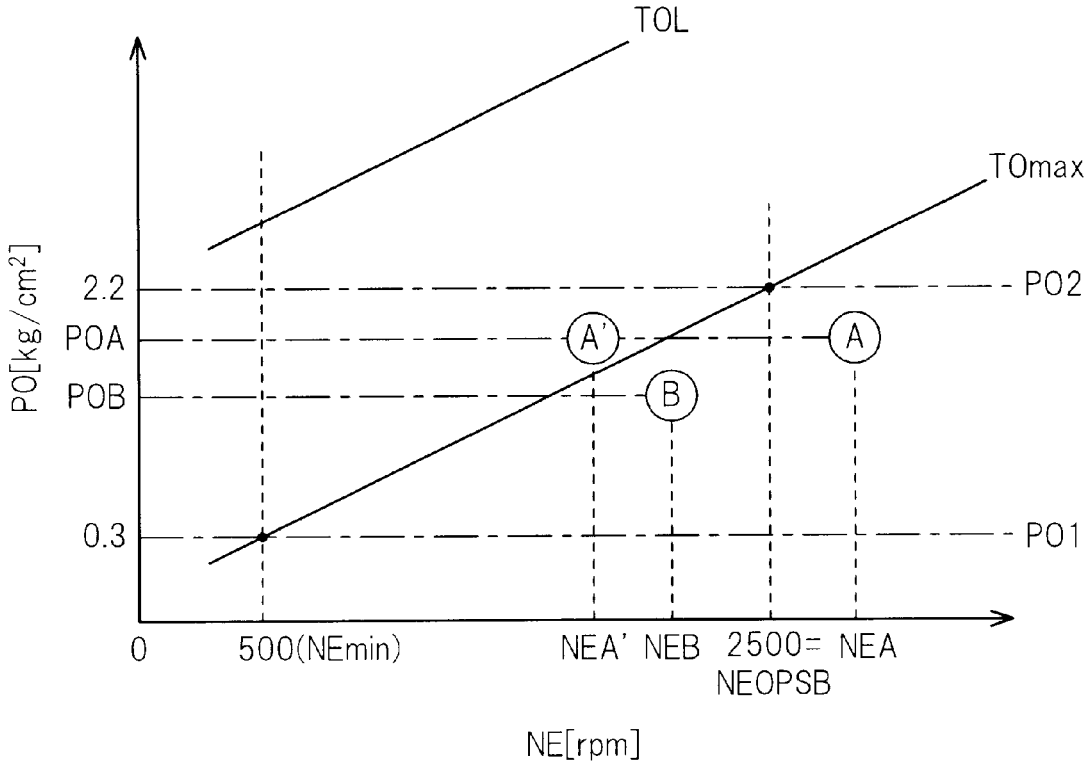
FIG. 8 is a view, similar to FIG. 5, similarly showing the first and second predetermined oil pressures indicative of the operating points of oil pressure switches set relative to the characteristic of (possible) maximum oil temperature TOmax and the engine speed NE, referred to in the flow chart of FIG. 6.

Explaining this further with reference to FIG. 8, assuming that the amount of oil is constant and the engine speed NE is less than or equal to 2500 rpm. When the oil temperature is low (i.e., TOL), since the oil pressure PO is greater than the second predetermined oil pressure PO2, the second oil pressure switch 114 generates the OFF signal. On the other hand, when the oil temperature is high (i.e., TOH), since the oil pressure PO is less than the second predetermined oil pressure PO2, the second oil pressure switch 114 generates the ON signal. Thus, the switch output depends on the oil temperature TO and this may lead to erroneous switch failure detection. However, the detection is suspended until the oil pressure TO has risen a certain level, erroneous detection can accordingly be avoided.

Figure 13:
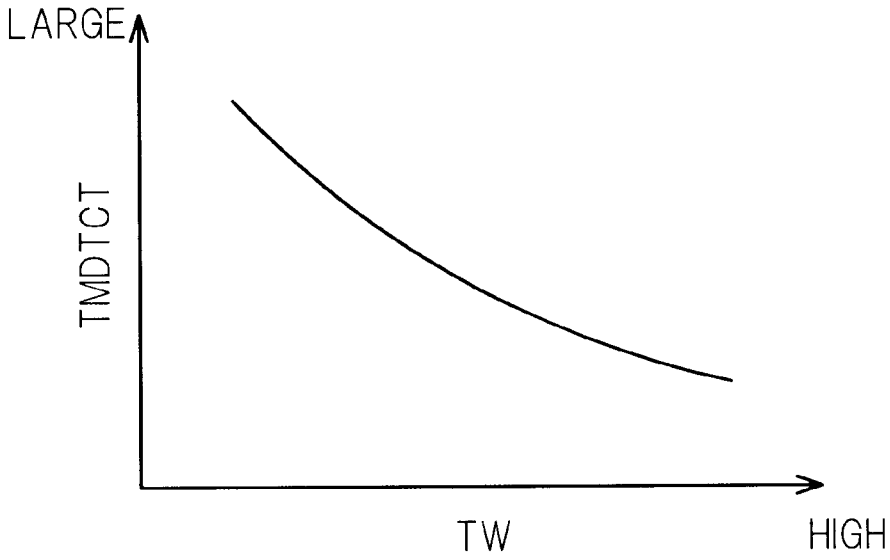
FIG. 13 is a time chart showing the relationship between a timer value TMDTCT and engine coolant temperature TW referred to in the flow chart of FIG. 12.
Figure 14:
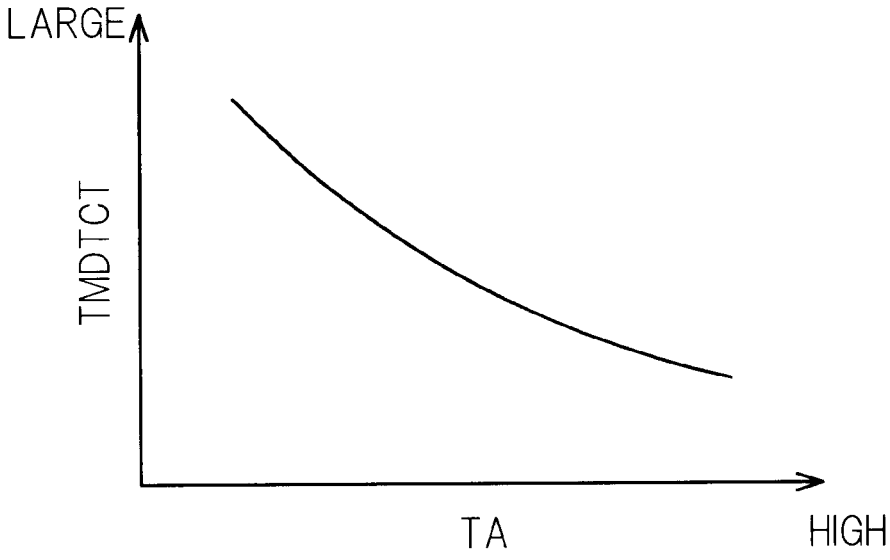
FIG. 14 is a view, similar to FIG. 13, but showing the relationship between the timer value TMDTCT and intake air temperature TA referred to in the flow chart of FIG. 12.

For this reason, the timer value TMDTCT is set with respect to a temperature indicative of that of the engine 16, i.e., the engine coolant temperature TW as illustrated in FIG. 13, or the intake air temperature TA as illustrated in FIG. 14. The timer value is set to be decreased with increasing engine coolant temperature TW or the intake air temperature TA. The reason is that, it takes a time until the oil temperature TO reaches the certain level when the temperature TW or TA is low, while it takes less time until the temperature TO reaches the same level when the temperature TW or TA is high.

Returning to the explanation of the flow chart of FIG. 12, the program proceeds to S206 in which the bit of a passing-confirmation flag CONF (explained later) is reset to 0.

When the result in S200 is negative, the program proceeds to S208 in which it is determined whether the first oil pressure switch 112 (at the low pressure side) generates the ON signal, in other words, it is determined whether the oil pressure is at or below the first predetermined pressure PO1. When the result is negative, in other words, when the lower-pressure-side first oil pressure 112 generates the OFF signal which indicates that the oil pressure is at or above the first predetermined oil pressure PO1, the program proceeds to S210 in which it is determined that the low pressure (PO1) is present.

Then the program proceeds to S212 in which it is determined whether the second oil pressure switch 114 (at high-pressure side) generates the ON signal, in other words, it is determined whether the oil pressure has not reached the second predetermined oil pressure PO2. When the result is negative, more specifically, when the high-pressure side second oil pressure switch 114 generates the OFF signal which indicates that oil pressure is at or above the second predetermined oil pressure PO2, the program proceeds to S214 in which it is determined that the higher pressure (PO2) is present.

Then the program proceeds to S216 in which it is determined that none of the first and second oil pressure switches fails, and proceeds to S218 in which the value of a failure-detection counter (up-counter) A is reset to zero. This counter A is counted up each time it is determine that there is the possibility that the second oil pressure switch 114 fails, i.e., each time it generates the ON signal, not the OFF signal).

On the other hand, when the result in S212 is affirmative, in other words, when the high-pressure side second oil pressure switch 114 generates the ON signal, the program proceeds to S220 in which it is determined whether the value of the timer tmDTCT has reached zero. When the result is negative, the program is immediately terminated for the reason mentioned above.

When the result in S220 is affirmative, the program proceeds to S222 in which it is determined whether the engine speed NE is greater than equal to a failure-detection-execution speed NEDTCT (predetermined value). Since the oil pressure varies with the change of engine speed, in order to take this into account, the failure detection is to be conducted when the engine speed NE is at or above NEDTCT. With this, it becomes possible to avoid erroneous detection.

Explaining this again referring to FIG. 8, assuming that the amount of oil is constant, and that the oil temperature TO at Tomax and is constant. When the engine speed NE is greater than or equal to 2500 rpm, since the oil pressure PO is greater than the second predetermined oil pressure PO2, the second oil pressure switch 114 generates the OFF signal. On the other hand, when the engine speed NE is less than 2500 rpm, since the oil pressure PO is less than the second predetermined oil pressure PO2, the second oil pressure switch 114 generates the ON signal. Thus, the switch output depends on the engine speed NE also and this may lead to erroneous switch failure detection. However, the detection is suspended until the engine speed NE has reached a certain level (i.e., the failure-detection-execution speed), erroneous detection can accordingly be avoided.

The failure-detection-execution speed NEDTCT set to be a speed (i.e., 2500 rpm) which can allow the oil temperature rises to a level, in accordance with the characteristic (i.e., Tomax) during a period of time until the value of the timer tmDTCT has reached zero, such that the second oil pressure switch 114 can generate the OFF signal. Accordingly, the fact that the results in S212, S220 and S222 are affirmative, indicates that there is the possibly that the second oil pressure switch 114 fails.

When the result in S222 is negative, the program is immediately terminated for the reason mentioned above. On the other hand, when the result in S222 is affirmative, the program proceeds to S224 in which it is checked whether the bit of the flag F.CONF is set to 1. When the result is affirmative, the program is immediately terminated, but when the result is negative, the program proceeds to S226 in which the value of the failure-detection counter A is incremented. The counter values is stored in the EEPROM 22*a* and is kept there even after the engine 16 has been stopped.

Then the program proceeds to S228 in which it is determined whether the value of the counter A is greater than or equal to 2. When the result is negative, the program proceeds to S230 in which the bit of the pass-confirmation flag F.CONF is set to 1. When the result in S228 is affirmative, the program proceeds to S232 in which it is determined that the second oil pressure switch 114 fails.

Then the program proceeds to S234 in which alarming is effected, more specifically, the oil pressure switch failure lamp 154 is turned on and the buzzer 158 is operated. With this, it becomes possible to inform the switch failure to the operator and prevent the engine 16 from being damaged.

The relationship between the passing-confirmation flag F.CONF and the failure-detection counter A will then be explained.

As will be understood from the above, the bit of the flag F.CONF is set to 1 only when the counter value is 1. When the flag bit is set to 1, the result in S224 is affirmative and no more counting us is made. In the next engine starting, when the result in S200 is affirmative, the program proceeds to S206 in which the flag bit is reset to 0. After the engine starting mode has finished, the counter value can further be incremented. The counter value is incremented each time the second oil pressure switch 114 presumably fails, but is reset to zero in S218 when such an indication is absent.

Thus, in this way, it is determined that the second oil pressure switch 114 fails when it generate the ON signal, not the OFF signal). This is because the amount of oil might be insufficient which simply results in the generation of ON signal. However, if the amount of oil is insufficient, the fact would be alarmed in S24 in the flow chart of FIG. 6. If so, the engine 16 would be stopped to be added with oil to a required level (amount). In view of these, the embodiment is configured such that the second oil pressure switch 114 is only determined to become failure when the generation of ON signal occurs consecutively during successive twice (two times) engine starting. More precisely, the switch failure is determined when the generation of ON signal occurs continuously at least two times including the last engine starting and the current engine starting. With this, it becomes possible to avoid erroneous switch failure detection.

Continuing the explanation of the flow chart of FIG. 12, when the result in S208 is affirmative, the program proceeds to S236 in which it is determined whether the second oil pressure switch 114 generates the ON signal. When the result is affirmative, in other words, when both the first and second oil pressure switches 112, 114 generates the ON signal, it is determined that both of the switches 112, 114 presumably fail and proceeds to S224 and on to follow the procedures mentioned above.

On the other hand, when the result in S236 is negative, in other words, when the second oil pressure switch 114 generates the OFF signal, but the first oil pressure switch 112 generates the ON signal, the program proceeds to S232 in which it is immediately determined that the first oil pressure switch 112 fails. The reason that no conditions concerning the oil temperature TO and the engine speed NE is prepared for determining the first switch failure is that, the first predetermined oil pressure PO1 (which the switch 112 must detect) is set to a minimum value which the engine operation other than that in starting mode) can produce. Therefore, once the engine 16 has been started, this oil pressure PO1 must normally be detected and when the first oil pressure switch 112 is determined to be failure, the pressure drop should naturally be alarmed in S24 of the flow chart of FIG. 6.

FIG. 15 is a table which illustrates the outputs (signals) of the first and second oil pressure switches 112, 114 and the determination based thereon.

Pattern 1 in the figure is a case in which the result in S208 and that in S212 are all negative, in other words, both the first and second oil pressure switches 112, 114 generate the OFF signal. Since they operate properly, it is determined in S216 that both are normal (do not fail).

Pattern 2 is a case in which the result in S208 is negative, but that in S212 is affirmative, in other words, the first oil pressure switch 112 generates the OFF signal, but the second oil pressure switch 114 generates the ON signal. If this occurs consecutively during two times successive engine starting, it is determined in S232 that the second oil pressure switch 112 fails for the reason mentioned above. Needless to say, this determination is only made when the execution of failure detection is allowed in S220 and S222.

Pattern 3 is a case in which the result in S208 is affirmative, but that in S236 is negative, in other wards, the second oil pressure switch 114 generates the OFF signal, but the first oil pressure switch 112 generates the ON signal. In this case, it is determined in S232 that the first oil pressure switch 112 fails.

Pattern 4 is a case in which the result in S208 is affirmative and in addition, the result in S236 is affirmative, in other words, both the first and second oil pressure switches 112, 114 generate the ON signal. When this occurs consecutively during successive two times engine starting, it is determined that both the first and second oil pressure switches 112, 114 fail.

Having been configured in the foregoing manner, in this embodiment, it is determined that whether the first and second oil pressure switches 112, 114 generate the predetermined outputs in response to the operating conditions, i.e., the predetermined outputs in response to the oil pressure PO when the engine speed NE is greater than or equal to the failure-detection-execution speed NEDTCT after a period of time corresponding to the value of the timer tmDTCT has passed since starting of the engine 16. With this, it becomes possible to detect the failure of the first and second oil pressure switches 112, 114 with accuracy with a simple configuration.

Further, since the switch failure detection is only conducted after the period of time corresponding to the value of the timer tmDTCT has passed since engine starting, in other words, the detection is suspended until the oil temperature TO has been expected to rise to a predetermined level, it becomes possible to avoid erroneous detection and to detect the failure of the first and second oil pressure switches 112, 114, in particular, that of the second oil pressure switch 114, accurately.

Further, since the system takes into account fact that the oil pressure varies with the change of engine speed and is configured to conduct the switch failure detection when the engine speed is greater than or equal to the predetermined engine speed NEDTCT, it can avoid erroneous detection and can detect the failure of the first and second oil pressure switches 112, 114, in particular, that of the second oil pressure switch 114, accurately.

Further, since the system is configured such that, when at least one of the first and second oil pressure switches 112, 114 is determined to be failure, alarming is effected, more specifically, the oil pressure switch failure lamp 154 is turned on and the buzzer 158 is operated to sound, it can surely inform the switch failure to the operator, thereby enable to prevent the engine 16 from being damaged.

Furthermore, since the switch failure is determined when the switch outputs remain unchanged continuously during starting the engine 16 two times successively, it can prevent the switch outputs due to deficiency of oil from being determined as switch failure, it becomes possible to detect the failure of the first and second oil pressure switches 112, 114, in particular, that of the second oil pressure switch 114 accurately Having been configured in the foregoing manner, in the system according to the embodiment, since the operating points (the aforesaid first and second predetermined oil pressures PO1, PO2) of the first and second oil pressure switches 114 and 116 are set relative to the oil pressure characteristic at the (possible) maximum oil temperature TOmax (under which the engine 16 has been sufficiently warmed up), the system does not misjudge the oil pressure drop due to oil temperature rise as the abnormal oil pressure.

Further, since the first predetermined oil pressure PO1 is set to a lowest pressure possibly experienced under normal operating condition of the engine 16, the system can detect the abnormal oil pressure, without fail, caused by leakage of oil, missing of addition of oil, etc. On the other hand, since the second predetermined oil pressure PO2 is set to a level under full engine load, the system can detect the abnormal oil pressure under high engine load and high engine speed, thereby enabling to surely avoid the engine 16 from being damaged by metal-to-metal contact.

Further, since the detected engine speed NE is compared with the predetermined engine speed NEOPSB (variable with the engine coolant temperature TW), the system can detect the abnormal oil pressure at an engine speed not more than the engine speed based on which the second predetermined oil pressure is set.

Further, since the oil pressure is immediately determined to be abnormal (low) from the output of the second oil pressure switch 114, when it can be judged from the manifold absolute pressure PBA and the engine speed NE that the oil pressure is abnormal, while the determination is delayed until the output of the switch 114 is kept unchanged for the predetermined period (corresponding to the timer value TMOPCA) when the oil pressure may return to a sufficient state, the system can detect and alarm the abnormality in the oil pressure more accurately.

Further, since the timer value TMOPCA is set to be increased with increasing engine coolant temperature TW, it can surely avoid erroneous detection The embodiment is thus configured to have a system for detecting failure of oil pressure switches which generate ON/OFF signals in response to a pressure of oil PO to be supplied to an internal combustion engine 16 for an outboard motor for a small boat 12, comprising: a first oil pressure switch 112 which generates an ON signal indicating that the oil pressure is less than or equal to a first predetermined oil pressure PO1; a second oil pressure switch 114 which generates an ON signal indicating that the oil pressure is less than or equal to a second predetermined oil pressure PO2 which is set higher than the first predetermined oil pressure PO1; switch signal discriminating means (ECU 22, S208, S212, S236) for discriminating whether the generated signals of the first and second oil pressure switches are equal to be expected signals expected under operating conditions of the engine; and switch failure determining means (ECU 22, S216, S232) for conducting a determination as to whether at least one of the first and second oil pressure switches fails based on a result of discrimination of the switch signal determining means.

In the system, the switch failure determining means conducts the determination after a predetermined period of time (value TMDTCT of the timer tmDTCT) has passed since starting of the engine (ECU 22, S220). The predetermined period of time is set with respect to a temperature TW, TA indicative of the engine 16. More specifically, the temperature is at least one of a coolant temperature TW of the engine and a temperature of intake air TA to be supplied to the engine 16. The predetermined period of time is set to be decreased with increasing temperature, as disclosed in FIGS. 13 and 14.

In the system, the switch failure determining means conducts the determination as to whether the second oil pressure switch 114 fails after the predetermined period of time has passed since starting of the engine (ECU 22, S212, S220).

The system further includes engine speed detecting means (crank angle sensor 126, ECU 22) for detecting a speed of the engine NE; and the switch failure determining means conducts the determination when the detected engine speed NE is greater than or equal to a predetermined engine speed NEDTCT (ECU 22, S222).

In the system, the switch failure determining means determines that the first and second oil pressure switches fails when it is discriminated that the first and second oil pressure switches 112, 114 do not generate the ON signals equal to the expected signals consecutively during a predetermined number (i.e., two times) of determination (ECU 22, S212, S236, S224 to S230). More specifically, the switch failure determining means determines that the first and second oil pressure switches 112, 114 fail when it is discriminated that the first and second oil pressure switches do not generate the signals equal to the expected signals consecutively during a predetermined number (i.e., two times) of determination conducted at each starting of the engine (ECU 22, S212, S236, S224 to S230).

In the system, the switch failure determining means determines that the second oil pressure switch fails when it is discriminated that the second oil pressure switch 114 does not generate the ON signal equal to the expected signal consecutively during a predetermined number (i.e. two times) of determination (ECU 22, S212, S224 to S230). More specifically, the switch failure determining means determines that the second oil pressure switch 114 fails when it is discriminated that the second oil pressure switch does not generate the signal equal to the expected signal consecutively during a predetermined number (i.e., two times) of determination conducted at each starting of the engine (ECU 22, S212, S224 to S230).

In the system, the first and second predetermined oil pressures PO1, PO2 are set to be oil pressures PO at a time after the engine has been warmed up. More specifically the first predetermined oil pressure PO1 is set to be an oil pressure PO at a load when the engine is idling and the second predetermined oil pressure PO2 is set to be an oil pressure PO at a load which is greater than the load when the engine is idling, more precisely the full load.

The system further includes alarm operating means (ECU 22, S234) for operating an alarm (lamp 154, buzzer 158); and the alarm operating means effects the alarm when the switch failure determining means determines that at least one of the first and second oil pressure switches 112, 114 fails.

it should be noted that, although the invention has been explained with reference to the oil pressure switches that output the ON/OFF signal, the invention is not limited to the disclose but can be applied to an oil pressure sensor which generates a signal proportional to the oil pressure.

It should also be noted that, although the invention has been explained with reference to an embodiment of an outboard motor, the invention is not limited in application to an outboard motor but can also be applied to an inboard motor.

The entire disclosure of Japanese Patent Application No. 2000-400350 filed on Dec. 28, 2000, including specification, claims, drawings and summary, is incorporated herein in reference in its entirety.

While the invention has thus been shown and described with reference to specific embodiments, it should be noted that the invention is in no way limited to the details of the described arrangements but changes and modifications may be made without departing from the scope of the appended claims.

What is claimed is:

1. A system for detecting failure of oil pressure switches which generate signals in response to a pressure of oil to be supplied to an internal combustion engine for an outboard motor for small boats, comprising:

a first oil pressure switch which generates a signal indicating that the oil pressure is less than or equal to a first predetermined oil pressure;

a second oil pressure switch which generates a signal indicating that the oil pressure is less than or equal to a second predetermined oil pressure which is set higher than the first predetermined oil pressure;

switch signal discriminating means for discriminating whether the generated signals of the first and second oil pressure switches are equal to expected signals expected under operating conditions of the engine;

and switch failure determining means for conducting a determination as to whether at least one of the first and second oil pressure switches has failed based on a result of discrimination of the switch signal determining means.

2. A system according to claim 1, wherein the switch failure determining means conducts the determination after a predetermined period of time has passed since starting of the engine.

3. A system according to claim 2, wherein the switch failure determining means conducts the determination as to whether the second oil pressure switch fails after the predetermined period of time has passed since starting of the engine.

4. A system according to claim 3, further including:

engine speed detecting means for detecting a speed of the engine; and wherein the switch failure determining means conducts the determination when the detected engine speed is greater than or equal to a predetermined engine speed.

5. A system according to claim 3, wherein the switch failure determining means determines that the second oil pressure switch fails when it is discriminated that the second oil pressure switch does not generate the signal equal to the expected signal consecutively during a predetermined number of determination.

6. A system according to claim 5, wherein the switch failure determining means determines that the second oil pressure switch fails when it is discriminated that the second oil pressure switch does not generate the signal equal to the expected signal consecutively during a predetermined number of determination conducted at each starting of the engine.

7. A system according to claim 2, wherein the switch failure determining means determines that the first and second oil pressure switches fail when it is discriminated that the first and second oil pressure switches do not generate the signals equal to the expected signals consecutively during a predetermined number of determination.

8. A system according to claim 7, wherein the switch failure determining means determines that the first and second oil pressure switches fail when it is discriminated that the first and second oil pressure switches do not generate the signals equal to the expected signals consecutively during a predetermined number of determination conducted at each starting of the engine.

9. A system according to claim 1, wherein the predetermined period of time is set with respect to a temperature indicative of the engine.

10. A system according to claim 9, wherein the temperature is at least one of a coolant temperature of the engine and a temperature of intake air to be supplied to the engine.

11. A system according to claim 9, wherein the predetermined period of time is set to be decreased with increasing temperature.

12. A system according to claim 1, wherein the first and second predetermined oil pressures are set to be oil pressures at a time after the engine has been warmed up.

13. A system according to claim 12, wherein the first predetermined oil pressure is set to be an oil pressure at a load when the engine is idling.

14. A system according to claim 12, wherein the second predetermined oil pressure is set to be an oil pressure at a which is greater than the load when the engine is idling.

15. A system according claim 1, further including:

alarm operating means for operating an alarm; and wherein the alarm operating means effects the alarm when the switch failure determining means determines that at least one of the first and second oil pressure switches fails.

16. A method of detecting failure of oil pressure switches which generate signals in response to a pressure of oil to be supplied to an internal combustion engine for an outboard motor for small boats, having a first oil pressure switch which generates a signal indicating that the oil pressure is less than or equal to a first predetermined oil pressure and a second oil pressure switch which generates a signal indicating that the oil pressure is less than or equal to a second predetermined oil pressure which is set higher than the first predetermined oil pressure, comprising the steps of:

(a) discriminating whether the generated signals of the first and second oil pressure switches are equal to be expected signals expected under operating conditions of the engine; and (b) conducting a determination as to whether at least one of the first and second oil pressure switches fails based on a result of the discrimination.

17. A method according to claim 16, wherein the step (b) conducts the determination after a predetermined period of time has passed since starting of the engine.

18. A method according to claim 17, wherein the step (b) conducts the determination as to whether the second oil pressure switch fails after the predetermined period of time has passed since starting of the engine.

19. A method according to claims 18, further including the step of:

detecting a speed of the engine; and wherein the step (b) conducts the determination when the detected engine speed is greater than or equal to a predetermined engine speed.

20. A method according to claim 18, wherein the step (b) determines that the second oil pressure switch fails when it is discriminated that the second oil pressure switch does not generate the signal equal to the expected signal consecutively during a predetermined number of determination.

21. A method according to claim 20, wherein the step (b) determines that the second oil pressure switch fails when it is discriminated that the second oil pressure switch does not generate the signal equal to the expected signal consecutively during a predetermined number of determination conducted at each starting of the engine.

22. A method according to claim 17, wherein the step (b) determines that the first and second oil pressure switches fail when it is discriminated that the first and second oil pressure switches do not generate the signals equal to the expected signals consecutively during a predetermined number of determination.

23. A method according to claims 22, wherein the step (b) determines that the first and second oil pressure switches fail when it is discriminated that the first and second oil pressure switches do not generate the signals equal to the expected signals consecutively during a predetermined number of determination conducted at each starting of the engine.

24. A method according to claim 16, wherein the predetermined period of time is set with respect to a temperature indicative of the engine.

25. A method according to claim 24, wherein the temperature is at least one of a coolant temperature of the engine and a temperature of intake air to be supplied to the engine.

26. A method according to claim 24, wherein the predetermined period of time is set to be decreased with increasing temperature.

27. A method according to claim 16, wherein the first and second predetermined oil pressures are set to be oil pressures at a time after the engine has been warmed up.

28. A method according to claim 27, wherein the first predetermined oil pressure is set to be an oil pressure at a load when the engine is idling.

29. A method according to claim 27, wherein the second predetermined oil pressure is set to be an oil pressure at a which is greater than the load when the engine is idling.

30. A method according claim 16, further including the step of: (c) operating an alarm; and operates the alarm when the step (b)determines that at least one of the first and second oil pressure switches fails.

* * * * *